US007228996B2

(12) United States Patent
Keller et al.

(10) Patent No.: US 7,228,996 B2
(45) Date of Patent: Jun. 12, 2007

(54) SELF-ADJUSTING CHILD HARNESS

(75) Inventors: Bryan R. Keller, Springboro, OH (US); Cynthia R. Nelson, Longmont, CO (US)

(73) Assignee: Evenflo Company, Inc., Vandalia, OH (US)

( * ) Notice: Subject to any disclaimer, the term of this patent is extended or adjusted under 35 U.S.C. 154(b) by 533 days.

(21) Appl. No.: 10/684,655

(22) Filed: Oct. 14, 2003

(65) Prior Publication Data

US 2005/0077331 A1 Apr. 14, 2005

(51) Int. Cl.
*A61G 1/00* (2006.01)

(52) U.S. Cl. ..... 224/161; 224/160

(58) Field of Classification Search ..... 224/158, 224/159, 160, 161
See application file for complete search history.

(56) References Cited

U.S. PATENT DOCUMENTS 3,841,543 A * 10/1974 Bolton ..... 224/158
5,020,709 A * 6/1991 Hoaglan ..... 224/155
5,503,461 A 4/1996 Schreier
5,626,271 A 5/1997 Messey et al.
5,868,292 A * 2/1999 Stephens et al. ..... 224/161
5,964,470 A * 10/1999 Syendsen et al. ..... 280/30
6,158,641 A 12/2000 Eyman et al.
6,318,608 B1 11/2001 Fowler et al.
6,575,342 B1 6/2003 Sundara et al.

* cited by examiner

*Primary Examiner*—Tri M. Mai
(74) *Attorney, Agent, or Firm*—Taft, Stettinius & Hollister LLP

(57) ABSTRACT

A child harness comprising: (a) a crotch support coupled to a frame, the crotch support adapted to provide a seat for a child and distribute the child's weight to the frame; and (b) an active restraint coupled to the frame and responsive to the movement of the child secured therein, the active restraint including a leg strap adapted to engage a leg of the child and a shoulder strap adapted to engage a shoulder of the child, where the leg strap is operatively coupled to the shoulder strap, and where movement of one of the leg's or shoulder's of the child to engage the leg strap or shoulder strap restraining that portion of the child's body operates to increase tension on the corresponding shoulder strap or leg strap on the same side of the child's body. The invention provides an action-reaction harness system as well as a method of accommodating a child's range of movements without compromising the integrity of the harness.

13 Claims, 3 Drawing Sheets

SELF-ADJUSTING CHILD HARNESS

FIELD OF THE INVENTION

The present invention is directed to a harness for securing a child; and, more particularly, to an active harness that automatically adjusts for the position of the child by providing one or more straps that are slidably mounted to a support structure.

BACKGROUND OF THE INVENTION

Child carriers permit transportation of a child within a backpack donned by a wearer. These carriers may comprise a rigid frame fabricated from aluminum tubing, a cockpit in which a child is secured typically through the use of one or more belts, and a mounting portion to which shoulder straps are attached to support the carrier on the back of a wearer. Additionally, many child carriers include waist belts that allow the wearer to secure the lower portion of the carrier firmly against the wearer's waist and lower back.

Prior art child carriers have been adjustable to fit the back of different-sized wearers and children seated therein. Generally, a shoulder strap length adjustment is provided, as is a waist belt size adjustment. Some child carriers also permit adjustment of the height of the waist belt, although current designs are somewhat cumbersome and do not permit the user to adjust the height while wearing a loaded child carrier. Typically, such adjustment mechanisms involve multiple straps, buckles and/or hook and loop connections requiring the wearer to adjust the height of the waist belt prior to placing the child in the carrier.

The shoulder straps that secure the child to the carrier are typically attached by way of stitching or rivets to the fabric covering a rigid frame and not directly to the frame itself. Consequently, given the flexible nature of the fabric straps, it is often difficult to adjust the shoulder straps precisely to a position that provides an optimum level of support and comfort for the child.

Typically, child restraint systems used in prior art carriers have incorporated a 5-point harness comprised of two shoulder straps, a crotch strap, and a waist belt. The term 5-point harness typically refers to the number of locations that the straps of the harness are attached to the seat or cockpit to which a child is to be restrained. 5-point harnesses typically do a good job of restraining the child; however, because of their design, a determined child could possibly loosen one or more of the shoulder straps by bracing against another strap, such as the crotch strap, to apply pressure to the shoulder strap and cause either or both straps to lengthen due to movement induced within each strap's adjustment buckle. In such a circumstance, the child could slide out of the carrier.

Other prior art carriers have included yokes being repositionable prior to the child being fastened within the harness. These repositionable yokes have utilize Velcro (fastening tape consisting of a strip of nylon with a surface of minute hooks that fasten to a corresponding strip with a surface of uncut pile) to facilitate holding the yoke in place. Such harnesses provide flexibility in fitting the harness to the child in the static position, but provide no vertical flexibility after the child is strapped into the harness. For instance, if the child were to attempt to raise his shoulder, the yoke would not allow for any appreciable upward movement in the shoulder strap.

SUMMARY OF THE INVENTION

The present invention is directed to a harness for securing a child; and, more particularly, to an active harness that automatically adjusts for the position of the child by providing one or more straps that are slidably mounted to a support structure.

In an exemplary embodiment, the present invention is teamed with a backpack carrier adapted to be donned by a wearer. The backpack carrier is coupled to the wearer for carrying the child for extended periods of time. The harness includes a pair of shoulder straps coupled to and originating at the rear of the child cockpit and are slidably mounted thereto. The shoulder straps extend to the front of the cockpit and travel through a loop or conduit and exit as leg straps to overlay each leg of the child, thereafter terminating at the rear of the cockpit. The straps are oriented in a V-shaped manner and utilized with a crotch support to secure the child within the carrier. After the child is secured within the harness, the child may begin to change bodily positions not provided for in prior art harnesses. The slidable nature of the shoulder straps enables the harness to respond to upward movement of a child's shoulder by tensioning a corresponding leg strap to hold the child within the harness. Alternate exemplary embodiments include side braces spanning between the front and rear of the cockpit to provide a lateral support for the child, and still further exemplary embodiments include the crotch support being pivotally mounted to the cockpit.

It is a first aspect of the present invention to provide a child harness comprising: (a) a crotch support coupled to a frame, the crotch support adapted to provide a seat for a child and distribute the child's weight to the frame; and (b) an active restraint coupled to the frame which is responsive to the movement of the child secured therein. In this aspect of the invention, the active restraint preferably includes a leg strap adapted to engage a leg of the child coupled to a shoulder strap adapted to engage a shoulder of the child, such that movement of the child within the seat is actively restricted by the coupled leg/shoulder strap.

In a more detailed embodiment of the first aspect, the leg strap and the shoulder strap comprise a single strap. In another more detailed embodiment, the shoulder strap is slidably mounted to a rear face operatively coupled to the frame. In yet another more detailed embodiment, a front face of the frame includes a loop through which the active restraint passes to mount the active restraint to the front face. In a further detailed embodiment, a rear face of the frame includes a loop to which the shoulder strap is slidably mounted thereto. In still a further more detailed embodiment, the loop includes a first portion of a quick-connect slidably mounted thereto, the shoulder strap includes a second portion of the quick connect, and the first portion and the second portion are adapted to be coupled together to couple the loop to the shoulder strap. In yet a further more detailed embodiment, the active restraint is adjustable in length. In another detailed embodiment, at least one of the leg strap and the shoulder strap are coupled to a quick-connect. In yet another more detailed embodiment, the quick-connect includes a buckle providing adjustability to a length of the active restraint. In still a further more detailed embodiment, the frame includes a front face, a rear face, a right side face spanning between the front face and the rear face, and a left side face spanning between the front face and the rear face, the crotch support and the right face at least partially define a right side orifice adapted to receive a right leg of the child, and the crotch support and the left side face at least partially define a left side orifice adapted to receive a left leg of the child.

In a more detailed embodiment of the first aspect, the active restraint includes at least a pair of straps, each strap including a leg strap and a shoulder strap. In a further detailed embodiment, a front face of the frame includes a conduit having at least one of the leg strap and the shoulder strap of the active restraint passing therethrough for coupling the active restraint to the front face of the frame. In yet a further detailed embodiment, the crotch support is coupled to a front fact and a rear face operatively coupled to the frame. In a more detailed embodiment, the active restraint includes a left side leg strap coupled to a left side shoulder strap, the active restraint includes a right side leg strap coupled to a right side shoulder strap, the left side leg strap is independent from the right side leg strap, and the right side shoulder strap is independent from the left side shoulder strap. In another more detailed embodiment, the shoulder strap includes a shoulder pad slidably mounted thereto adapted to pad the shoulder of the child. In yet another detailed embodiment, the frame is coupled to a backpack adapted to be worn by a wearer. In still another more detailed embodiment, the backpack includes at least one shoulder strap and a waist strap adapted to attach the backpack to the wearer. In an even more detailed embodiment, the backpack includes a retractable brace adapted to stand the backpack upright and support the child seated on the crotch support when the wearer does not don the backpack.

In a more detailed embodiment of the first aspect, side supports spanning between a front face and a rear face of the frame are adapted to limit a range of movement in a lateral direction of the child. In another more detailed embodiment, a head pad is integrated into a rear face of the frame. In yet another more detailed embodiment, a rear aspect of the crotch support is coupled to a rear face of the frame and a front aspect of the crotch support is pivotally coupled to the frame.

It is a second aspect of the present invention to provide a backpack carrier comprising: (a) a cockpit adapted to house a child therein comprising: (i) a child seat operatively coupled to the cockpit and distributing a majority of the child's weight to a frame; (ii) a first active restraint slidably coupled to a back support operatively coupled to the frame, at least a portion of the first active restraint is adapted to overlie a first shoulder of the child; (iii) a second active restraint slidably coupled to the back support operatively coupled to the frame, at least a portion of the second active restraint is adapted to overlie a second shoulder of the child, where the first active restraint and the second active restrain are slidably repositionable after the child is restrained within the cockpit to automatically accommodate an increased range of movement; and (b) a harness to be donned by a user coupled to the frame for carrying the cockpit.

In a more detailed embodiment of the second aspect, the first active restraint is adapted to concurrently overlie the first shoulder of the child and a first leg of the child, and the second active restraint is adapted to concurrently overlie the second shoulder of the child and a second leg of the child. In another more detailed embodiment, at least one of the first active restraint and the second active restraint includes a quick-connect. In yet another more detailed embodiment, the quick-connect is mounted in series with a buckle operative to manipulate the length of one of the first active restraint and the second active restraint. In a more detailed embodiment, the first active restraint and the second active restraint are coupled to the front of the cockpit. In a further detailed embodiment, the child seat is pivotally mounted to the cockpit. In still a further more detailed embodiment, the cockpit is adapted to panoramically surround the child. In yet a further more detailed embodiment, the first active restraint is reactive to upward movement of the first leg of the child by limiting concurrent upward movement of the first shoulder of the child, the second active restraint is reactive to upward movement of the second leg of the child by limiting concurrent upward movement of the second shoulder of the child, the first active restraint is reactive to upward movement of the first shoulder of the child by limiting concurrent upward movement of the first leg of the child, and the second active restraint is reactive to upward movement of the second shoulder of the child by limiting concurrent upward movement of the second leg of the child.

It is a third aspect of the present invention to provide a method of fastening a child within a child restraint, the method comprising the steps of: (a) positioning a child upon a seat coupled to a frame such that a left leg of the child is overlaid by a first leg strap and a right leg of the child is overlaid by a second leg strap; (b) positioning a first shoulder strap over a left shoulder of the child; (c) positioning a second shoulder strap over a right shoulder of the child; (d) tensioning the first shoulder strap and the second shoulder strap to secure the child to the frame between the first shoulder strap and the second shoulder strap and the seat; and (e) coupling the first shoulder strap to the first leg strap and coupling the second shoulder strap to the second leg strap to provide at least two responsive straps, where the first shoulder strap and second shoulder strap are slidably mounted to the frame, and where movement of the child after the tensioning step will be limited, but accommodated, by alternating tension between the first shoulder strap and the first leg strap and by alternating tension between the second shoulder strap and the second leg strap.

In a more detailed embodiment of the third aspect, at least one of the first shoulder strap, the second shoulder strap, the first leg strap, and the second leg strap include a quick-coupling having a buckle for varying a length of the strap. In another more detailed embodiment, the first shoulder strap and the second shoulder strap are slidably mounted to a loop operatively coupled to the frame.

DETAILED DESCRIPTION

The exemplary embodiments of the present invention are described and illustrated below as child harnesses operatively coupled to a support structure, and more specifically to a backpack carrier incorporating an exemplary child harness adapted to be donned by a wearer. The various orientational, positional, and reference terms used to describe the elements of the exemplary harnesses are therefore used according to this frame of reference. However, for clarity and precision, only a single orientational or positional reference will be utilized. Therefore, it will be understood that the positional and orientational terms used to describe the elements of the exemplary embodiments of the present invention are only used to describe the elements in relation to one another.

Figure 1:
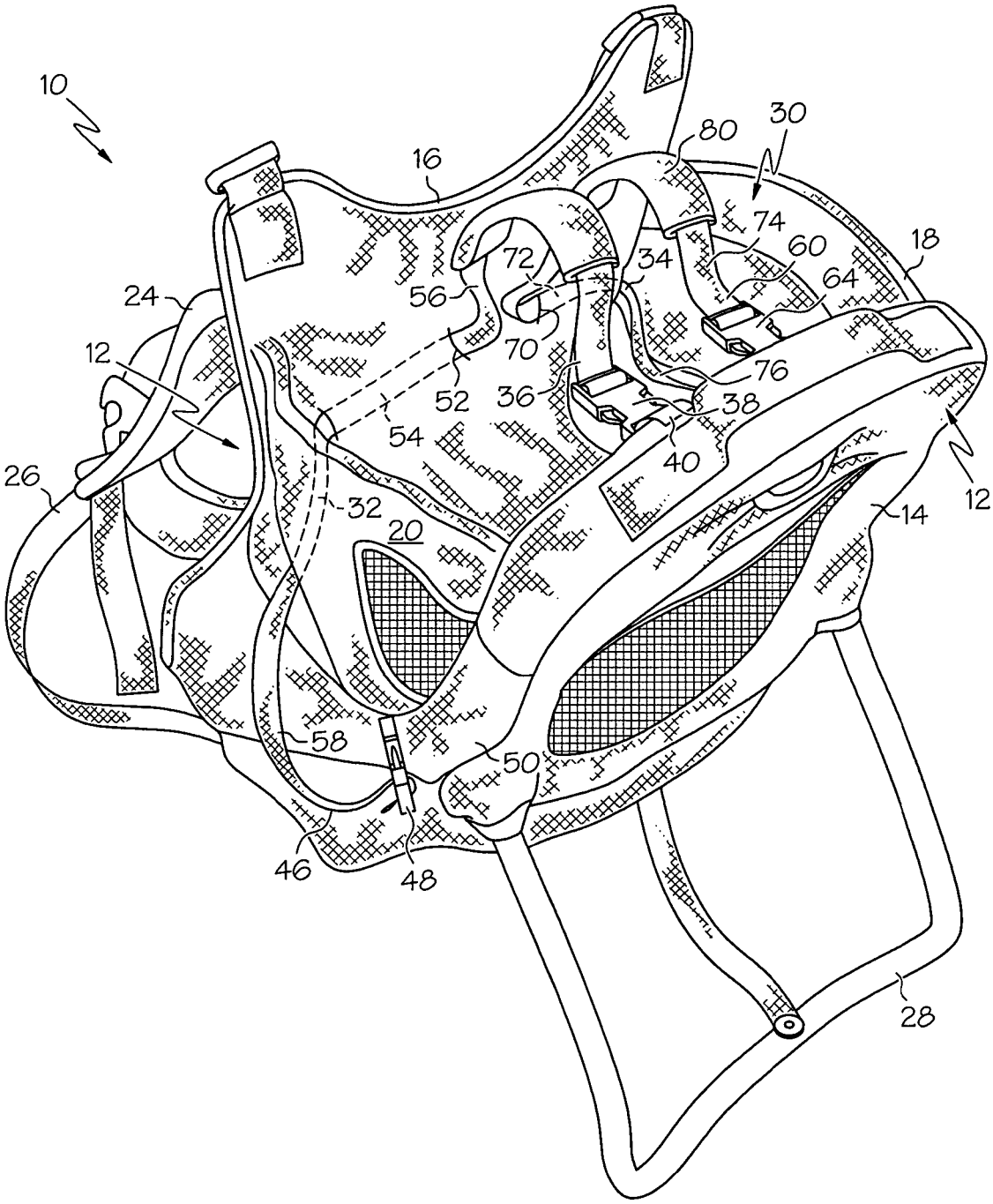
FIG. 1 is an elevated perspective view from the rear of an exemplary harness in accordance with the present invention mounted to a backpack carrier.
Figure 2:
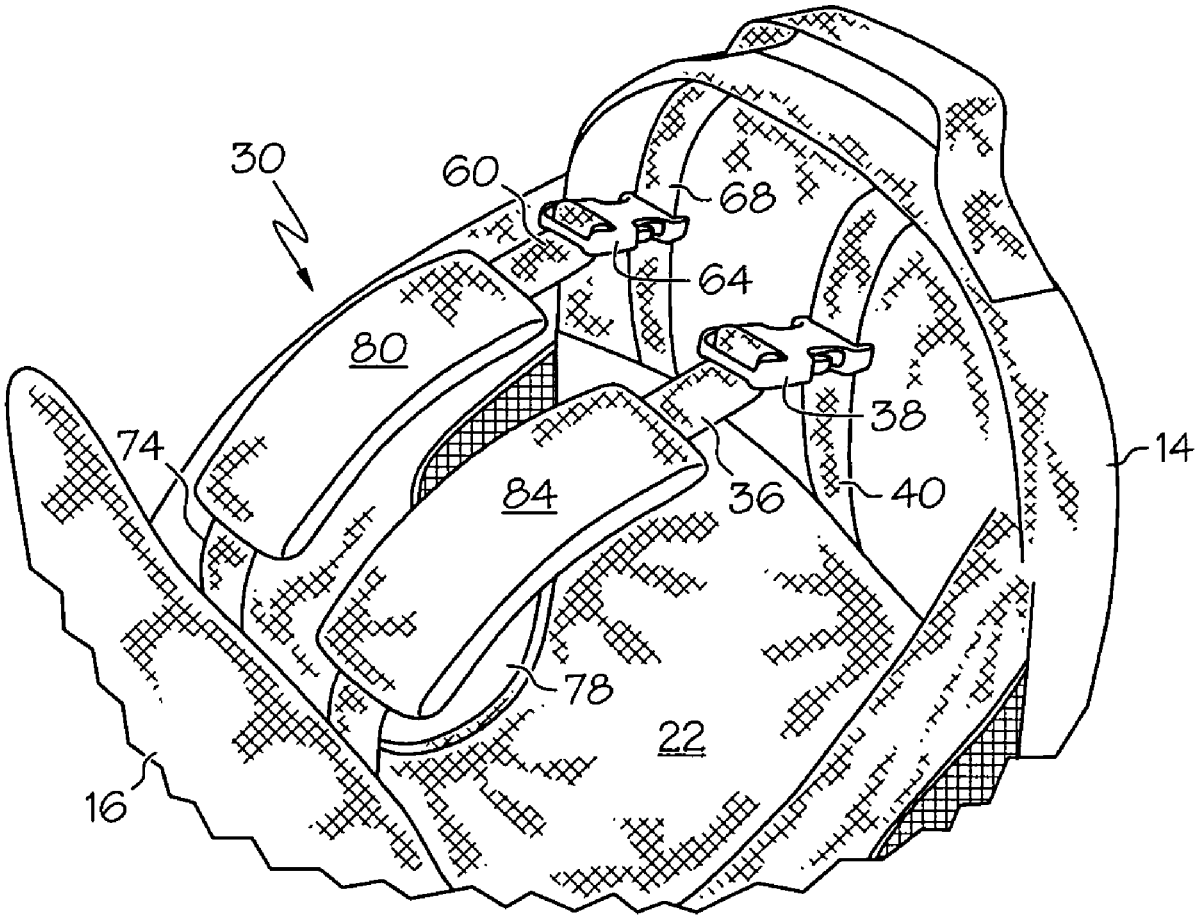
FIG. 2 is an elevated perspective segment view of a portion of the exemplary harness in accordance with the present invention.
Figure 3:
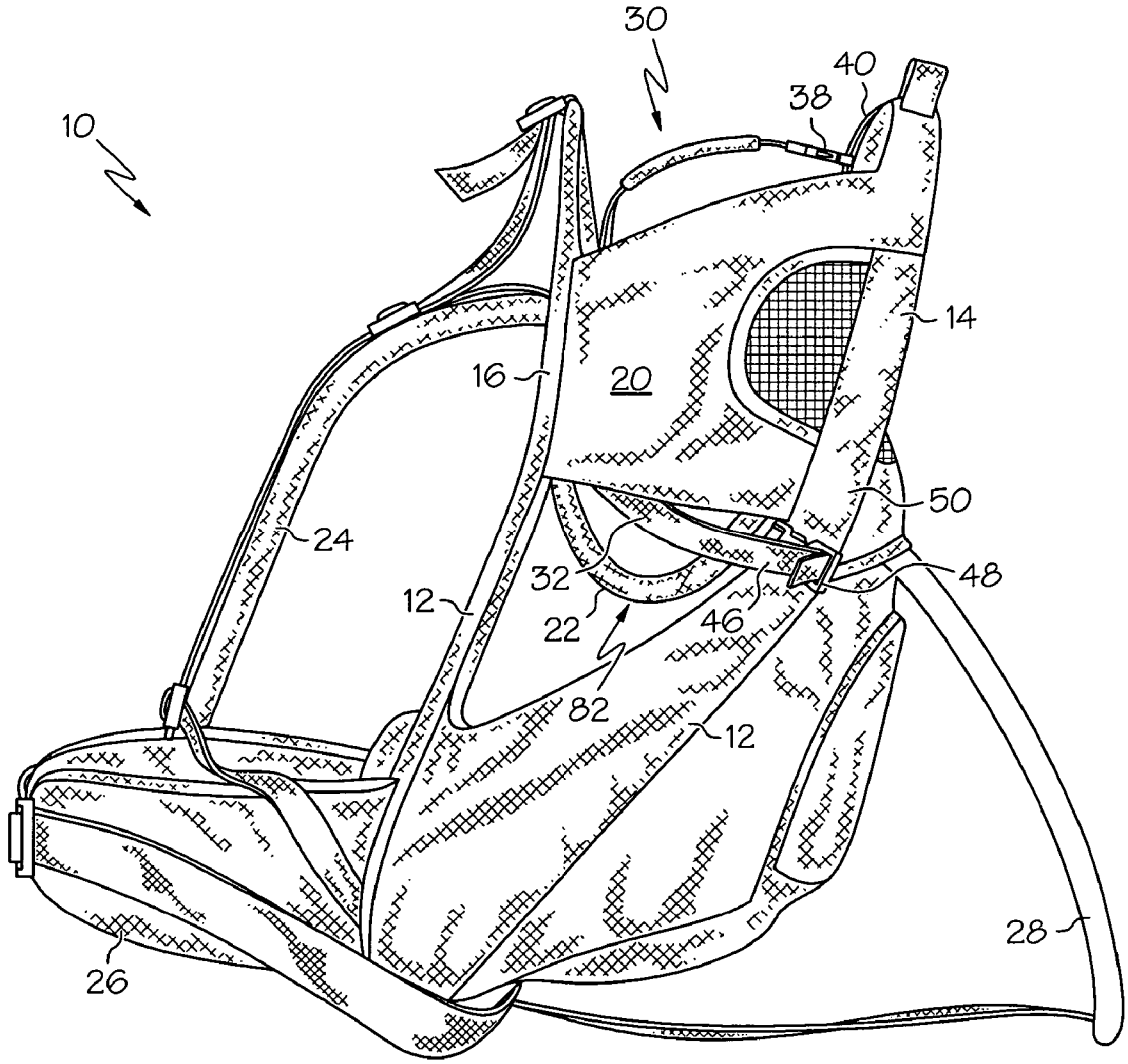
FIG. 3 is a left side view of the exemplary harness in accordance with the present invention mounted to a backpack carrier.

Referencing FIGS. 1–3, a child backpack 10 is shown having a frame structure 12 for supporting a child therein. The frame structure 12 includes a back support 14, a front support 16, a right side support 18, and a left side support 20, where the side supports 16, 18 bridge and couple the back support 14 to the front support 16. A crotch support 22 spans between the front support 16 and back support 14 and is coupled thereto to distribute the weight of the child to the frame structure 12. The front of the crotch support 22 may be pivotally mounted to the front support 16. The frame structure 12 also includes backpack shoulder straps 24 and a waist strap 26 to be secured to a wearer of the backpack 10. A kickstand 28 is pivotally mounted to the frame structure 12 and may be positioned away from the frame structure 12 to provide a wider stance for the backpack 10 and facilitate upright positioning of the backpack 10 while the wearer is not donning at least one of the backpack shoulder straps 24 and waist strap 26.

A child harness 30 is coupled to the frame structure 12 and includes a left side strap 32 and a right side strap 34 to secure the child to the frame structure 12. A first end 36 of the left side strap 32 includes a quick-connect 38 slidably coupled to a left side loop 40 attached to the back support 14. An opposing end 46 of the left side strap 32 includes a quick-connect 48 coupled to a lower aspect 50 of the back support 14 on the left side. An opening 52 within the front support 16 provides a left conduit 54 through which the left side strap 32 may slide therethrough. The conduit 54 effectively apportions the left side strap 32 into a left shoulder segment 56 and a left leg segment 58.

The right side strap 34 is analogously coupled at each end 60 via a quick-connect 64. The first quick-connect 64 is slidably coupled to a right side loop 68 attached to the back support 14 and the second quick-connect (not shown) is coupled to the lower aspect 50 of the back support 14 on the right side. An opening 70 within the frontal support 16 provides a right conduit 72 through which the right side strap 34 may slide therethrough. The conduit 72 effectively apportions the right side strap 34 into a right shoulder segment 74 and a right leg segment 76.

To secure a child within the harness 30, one or more of the quick-connects 38, 48, 64 may be disconnected prior to lowering the child within the harness. The child is lowered into the harness and seated upon the crotch support 22 such that the child's right leg pierces an opening 78 on the right side defined by the back support 14, the front support 16, the right side support 18, and the crotch support 22. The right leg segment 76 is placed on top of the child's right leg and coupled to the lower aspect 50 of the back support 14 if previously disconnected. A shoulder pad 80 riding along the right shoulder segment 74 is positioned over the child's right shoulder after the child is seated upon the crotch support 22. The right side strap 34 is drawn and coupled to the back support 14 if previously disconnected. Each quick-connect 38, 48, 64 may include an integrated buckle to adjust the length of the strap 32, 34 coupled thereto.

An analogous procedure is followed for the securing the child within the left side of the harness 30. The child's left leg is lowered into the harness 30 to pierce an opening 82 on the left side defined by the back support 14, the front support 16, the left side support 20, and the crotch support 22. The left leg segment 58 is placed on top of the child's left leg and coupled to the lower aspect 50 of the back support 14 if previously disconnected. A shoulder pad 84 riding along the left shoulder segment 56 is positioned over the child's left shoulder after the child is seated upon the crotch support 22. The left side strap 32 is drawn taught and coupled to the back support 14 if previously disconnected.

A child might utilize one or both legs to push against an object and propel himself upward and potentially out of a prior art harness. However, the harness 30 of the present invention provides an action-reaction system allowing a range of movement to the child while concurrently making interdependent the range of movement of the child's legs and shoulders. The child is secured within the harness 30 so that the left side strap 32 is drawn to ride against the child's left leg and left shoulder, while the right side strap 34 is drawn to ride against the child's right leg and right shoulder. As discussed above, the left side strap 32 and right side strap 34 may each comprise a single strap responsive to movement of the child's left leg, right leg, right shoulder, and/or left shoulder. A movement by any of these body parts will cause an action-reaction response between the leg segments 58, 76 and the shoulder segments 56, 74. In other words, a slack movement of a leg segment 58, 76 will pull taught the corresponding shoulder segment 56, 74 coupled thereto and a slack movement of a shoulder segment 56, 74 will pull taught the corresponding leg segment 58, 76.

For instance, if the child raises his left leg to push against the left leg segment 58 and increases the length of the left leg segment 58, the length of the left shoulder segment 56 will decrease causing the left shoulder segment 56 to be pulled taught and restrict upward movement of the child's left shoulder. The decreased length of the left shoulder segment 56 may cause the quick-connect 38 to slide along the loop 40 and be repositioned. Conversely, movement against the left shoulder segment 56 to increase the length of the left shoulder segment 56 will decrease the length of the left leg segment 58 to pull taught the left leg segment 58 and limit the range of movement of the child's leg necessary for the child to propel himself upward. This increased length of the left shoulder segment 56 may cause the quick-connect 38 to slide along the loop 40 to accommodate such movement. An analogous action-reaction process would occur between the right leg segment 76 and the right shoulder segment 74 upon movement against either segment by the child's right leg or right shoulder. What is common to each strap 32, 34 is the concept that the length of each strap is relatively fixed after strapping the child within the harness 30 and that concurrent upward movement between a leg and shoulder on the same side of the body is inhibited.

Following from the above description and invention summaries, it should be apparent to those of ordinary skill in the art that, while the methods and apparatuses herein described constitute exemplary embodiments of the present invention, the inventions contained herein are not limited to these precise embodiments and that changes may be made to them without departing from the scope of the invention as defined by the claims. Additionally, it is to be understood that the invention is defined by the claims and it is not intended that any limitations or elements describing the exemplary embodiments set forth herein are to be incorporated into the meanings of the claims unless such limitations or elements are explicitly recited in the claims. Likewise, it is to be understood that it is not necessary to meet any or all of the identified advantages or objects of the invention disclosed herein in order to fall within the scope of any claim, since the invention is defined by the claims and since inherent and/or unforeseen advantages of the present invention may exist even though they may not have been explicitly discussed herein.

What is claimed is:

1. A child harness comprising:

a crotch support coupled to a frame, the crotch support adapted to provide a seat for a child and distribute the child's weight to the frame;

an active restraint coupled to the frame and responsive to the movement of the child secured therein, the active restraint including a leg strap adapted to engage a leg of the child and a shoulder strap adapted to engage a shoulder of the child;

wherein the leg strap is operatively coupled to the shoulder strap;

wherein movement of one of the legs or shoulders of the child to engage the leg strap or shoulder strap restraining that portion of the child's body operates to increase tension on the corresponding shoulder strap or leg strap on the same side of the child's body;

wherein a rear face of the frame includes a loop to which the shoulder strap is slidably mounted thereto;

wherein the loop includes a first portion of a quick-connect slidably mounted thereto;

wherein the shoulder strap includes a second portion of the quick connect; and wherein the first portion and the second portion are adapted to be coupled together to couple the loop to the shoulder strap.

2. The child harness of claim 1, wherein the leg strap and the shoulder strap comprise a single strap.

3. The child harness of claim 1, wherein the active restraint is adjustable in length.

4. The child harness of claim 1, wherein the crotch support is coupled to a front face and a rear face operatively coupled to the frame.

5. The child harness of claim 1, wherein a front face of the frame includes a conduit having ax least one of the leg strap and the shoulder swap of the active restraint passing therethrough for coupling the active restraint to the front face of the frame.

6. The child harness of claim 1, wherein:

the active restraint includes a left side leg strap coupled to a left side shoulder strap;

the active restraint includes a right side leg swap coupled to a right side shoulder strap;

the left side leg strap is independent from the right side leg strap; and the right side shoulder strap is independent from the left side shoulder strap.

7. The child harness of claim 1, wherein the shoulder strap includes a shoulder pad slidably mounted thereto adapted to pad the shoulder of the child.

8. The child harness of claim 1, wherein the frame is coupled to a backpack adapted to be worn by a wearer.

9. The child harness of claim 8, wherein the backpack includes at least one shoulder strap and a waist strap adapted to attach the backpack to the wearer.

10. The child harness of claim 8, wherein the backpack includes a retractable brace adapted to stand the backpack upright and support the child seated on the crotch support when the wearer does not don the backpack.

11. The child harness of claim 1, wherein:

the frame includes a front face, a rear face, a right side face spanning between the front face and the rear face, and a left side face spanning between the front face and the rear face;

the crotch support and the right face at least partially define a right side orifice adapted to receive a right leg of the child; and the crotch support and the left side face at least partially define a left side orifice adapted to receive a left leg of the child.

12. The child harness of claim 1, further comprising side supports spanning between a front face and a rear face of the frame that are adapted to limit a range of movement in a lateral direction of the child.

13. The child harness of claim 1, wherein a rear aspect of the crotch support is coupled to a rear face of the frame and a front aspect of the crotch support is pivotally coupled to the frame.

* * * * *